US005943929A

United States Patent [19]

Sebesta

[11] Patent Number: 5,943,929

[45] Date of Patent: Aug. 31, 1999

[54] BULLET BLADE KNIFE AND METHOD OF OPERATION THEREOF

[76] Inventor: Wayne Anthony Sebesta, 135 King George Dr., New Windsor, N.Y. 12553

[21] Appl. No.: 08/946,819

[22] Filed: Oct. 8, 1997

[51] Int. Cl.[6] ..... B26B 3/08

[52] U.S. Cl. ..... 83/13; 30/321; 30/320

[58] Field of Search ..... 83/13, 662, 663, 83/665, 666, 34, 995, 879, 881, 699.31, 699.51; 30/159, 314, 317, 320, 321, 303, 2, 155, 344

[56] References Cited

U.S. PATENT DOCUMENTS

| | | | |
|---|---|---|---|
| 257,289 | 5/1882 | Carlton et al. | 30/321 |
| 363,561 | 5/1887 | Stoddard | 30/321 |
| 613,241 | 11/1898 | Burton | 30/320 |
| 1,520,711 | 12/1924 | Habart | 30/320 |
| 1,614,243 | 1/1927 | Illg | 30/320 |
| 1,619,249 | 3/1927 | Duff | 30/320 |
| 1,821,718 | 9/1931 | Melcher | 30/2 |
| 1,843,535 | 2/1932 | Arnold | 30/2 |
| 1,903,264 | 3/1933 | Palin | 30/321 |
| 1,917,779 | 7/1933 | Stowell | 30/321 |
| 1,940,169 | 12/1933 | Hinton | 30/321 |
| 2,215,216 | 9/1940 | Gits et al. | 30/320 |
| 2,264,960 | 12/1941 | Vinton | 30/2 |
| 2,530,236 | 11/1950 | Erickson | 30/159 |
| 2,601,402 | 6/1952 | Krause et al. | 30/320 |
| 2,607,115 | 4/1952 | Iovinelli | 30/321 |
| 2,908,972 | 10/1959 | Nitenson | 30/321 |
| 4,148,142 | 4/1979 | Sullivan et al. . | |
| 4,262,419 | 4/1981 | Pierce | 30/321 |
| 4,443,942 | 4/1984 | Demeter . | |
| 4,713,885 | 12/1987 | Keklak et al. . | |
| 4,761,884 | 8/1988 | Nguyen et al. . | |
| 4,868,985 | 9/1989 | Rehm . | |
| 4,936,014 | 6/1990 | Shaanan et al. . | |
| 5,025,558 | 6/1991 | Gilbert . | |
| 5,042,154 | 8/1991 | Gilbert . | |
| 5,144,749 | 9/1992 | Chen . | |
| 5,203,086 | 4/1993 | Dann . | |
| 5,301,428 | 4/1994 | Wilcox . | |
| 5,425,175 | 6/1995 | Rogers . | |
| 5,438,757 | 8/1995 | Weschenfelder . | |
| 5,490,331 | 2/1996 | Gold . | |
| 5,511,261 | 4/1996 | Collins . | |

*Primary Examiner*—M. Rachuba
*Assistant Examiner*—Gyounghyon Bae
*Attorney, Agent, or Firm*—Graham S. Jones, II

[57] ABSTRACT

A utility tool has a knife blade and a housing. The housing includes a handle for supporting the knife blade adjustably in a manner so that the blade is rotatable on a shaft for supporting the blade. The shaft is carried by a pair of bearings to a plurality of fixed angular positions. Means are provided for locking the knife blade in the fixed angular positions. The housing includes a flat base having an external surface adapted to be supported upon work to be cut by the knife blade. The flat base of the housing includes a hole therethrough for the blade to extend into positions for cutting the work to be located below the base. The means for locking the knife blade in the fixed angular positions includes spring biasing means for holding the means for locking in a locked position. There is a harness for supporting the blade to prevent rotation of the blade during cutting.

20 Claims, 6 Drawing Sheets

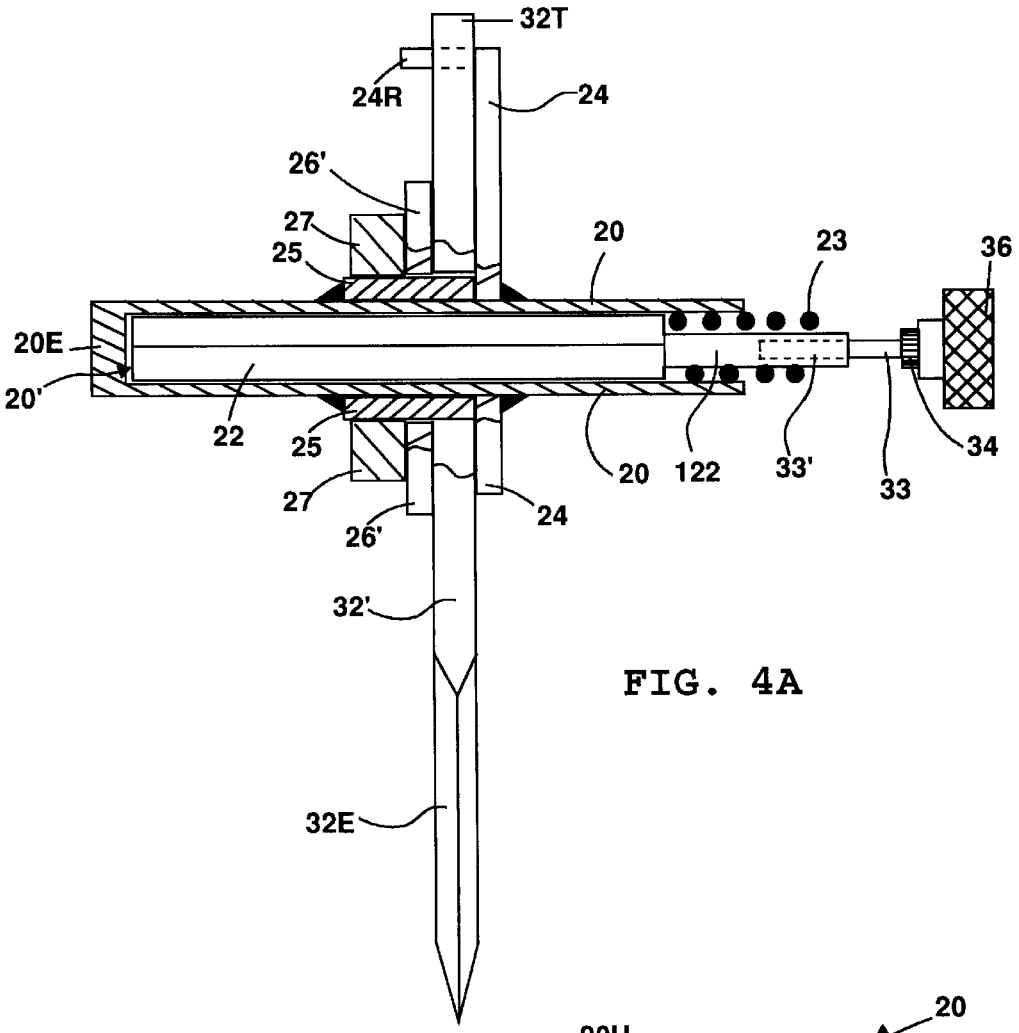
FIG. 4A
FIG. 4B
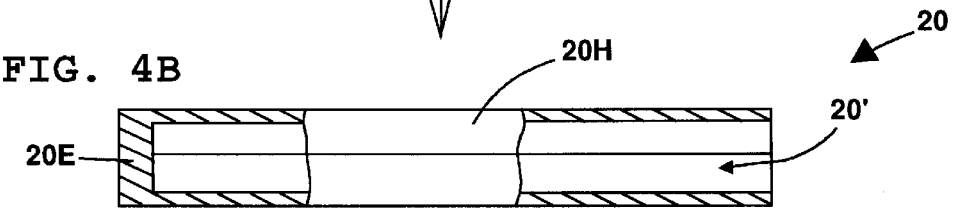
FIG. 4C
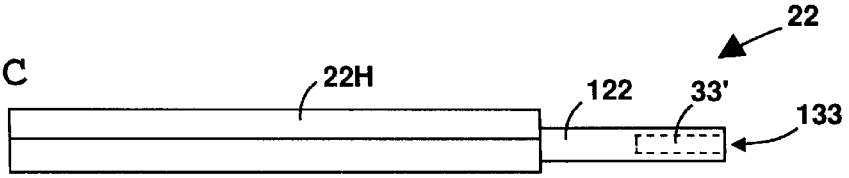

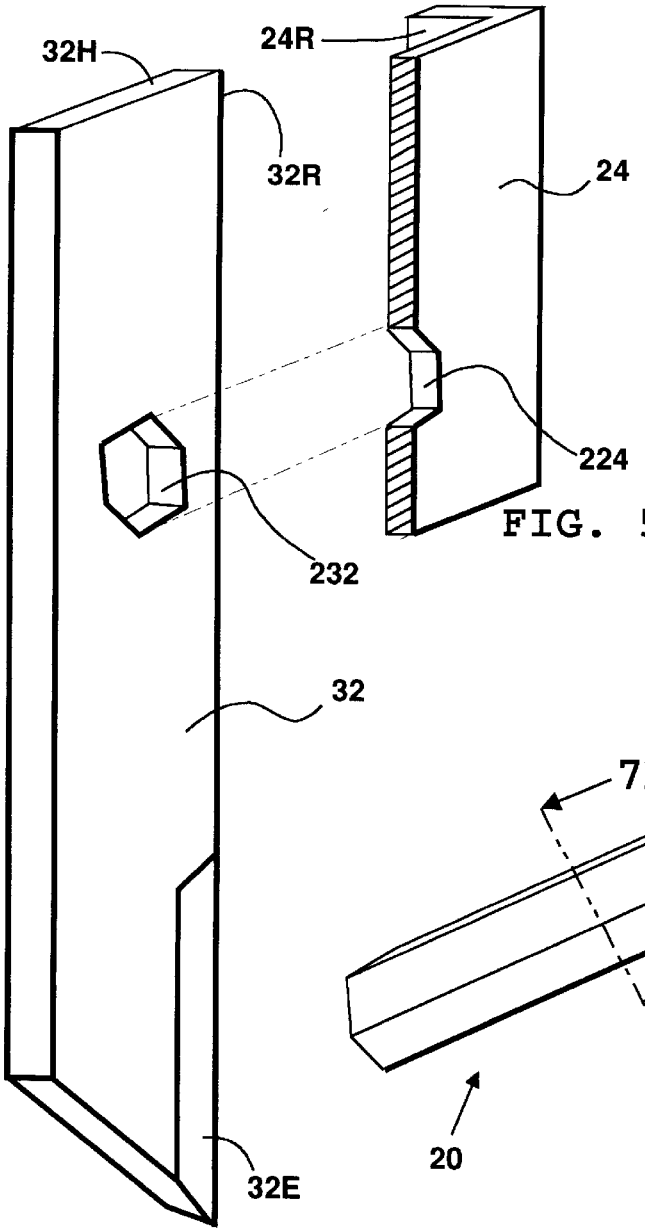
FIG. 5A
FIG. 5B
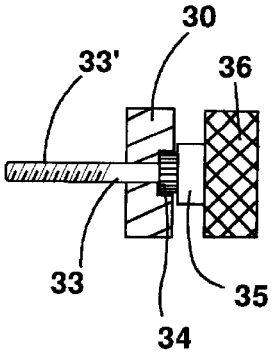
FIG. 6
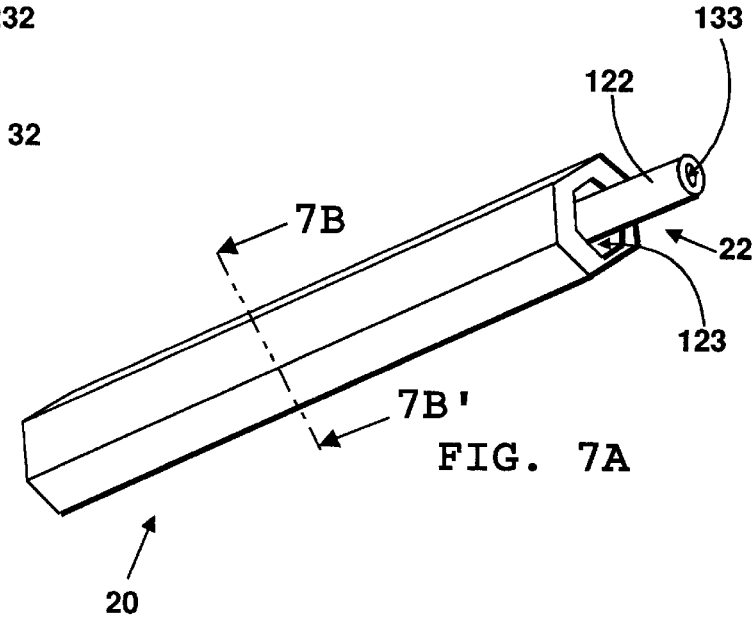
FIG. 7A
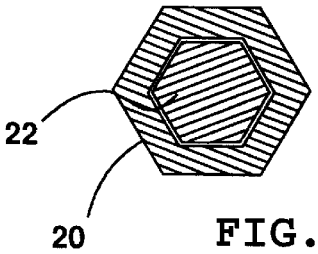
FIG. 7B

BULLET BLADE KNIFE AND METHOD OF OPERATION THEREOF

BACKGROUND OF THE INVENTION

1. Field of the Invention

This invention relates to cutting tools and more particularly to adjustable position utility knives.

2. Description of Related Art

U.S. Pat. No. 4,443,942 of Demeter for a "Tool for Trimming Lapping Edge Portions of Sheet Material" shows a base 22 with a central guide slot 44 through which a cutting blade 26 is extended. Blade 26 is held in a handle 24 which pivots about pin 50 supported by post 48 on base 22. Blade 26 is a commercial blade apparently identical to the blades of conventional utility knives. There is an adjustment device 46 which controls how deeply the handle can be pushed down by the operator to drive the blade 26 through the slot 44 to cut the work below the slot. As contrasted with your invention, in Demeter the blade handle 24 is pivoted relative to the base 22 rather than being in a fixed position relative to the base and although the depth of cut is controlled, it is done differently from the device 46 since the blade handle 24 is pivoted. This is the only reference which is adapted for a similar use to the tool of the present invention in that it provides excellent lateral angular stability of the blade relative to the work and it is useful to cut sheet rock, etc. A significant difference is that the base 22 is supported not by the work but by the wheels 36 which ride on the work being trimmed by the blade 26. As the work sheets 14 are overlapped at edge portions 20, the wheels are required to hold the tool above the sheets 14.

U.S. Pat. No. 5,203,086 Dann "Cutting Apparatus" shows a hand held cutter with a blade 22 seen in FIG. 9 which can be slid down by pushing down on the blade holder when knurled nut 31 is loosened for adjustment. Note that it is stated at Col. 3, lines 41–46, the blade 22 is "mounted outboard of the body 10, so that the region of cutting contact 60 of the blade is readily visible to the user so that he can see exactly where the cut is being made, and where the desired path of the cut lies." There is a flat surface 16 on the bottom of the body of the tool which provides a narrow guide surface along which the blade is drawn to stabilize it in its position at right angles to the surface of the work being cut. (Col. 2, lines 60–65. The guide surface of this invention is a wide base which provides stability of the blade. The "base" 16 of Dann is very narrow and provides a poor degree of angular stability. Another difference is that in your invention the blade contact with the work is obscured by the blade holder body and the direction can be seen at the front and back ends of the blade holder. In addition, the blade of Dann appears to slide at a fixed angle into and out of the retracted position whereas in the present invention, in its current design, the adjustment of the blade involves a quick adjustment step, when the tool is not being used to cut, involving rotation of the blade through an angle to change the depth of the cut made by the blade.

U.S. Pat. No. 4,148,142 Sullivan et al. "Carpet Cutter" shows a blade holder assembly 40 shown in FIG. 4A with opposed leg portions 14, 14' through which a carpet C is pushed in FIG. 2. A handle 20 pivots about journal element 28 to push a blade holder 40 carrying a blade 36 which can extend down through an opening (hole) 18 in the upper leg portion 14 into an opening (hole) 18' in the lower leg portion 14'. The blade 36 is retained in an adjustable position in the blade cover 42 by a bolt 62 which fastens the blade into hole 64 in handle 24, as seen in FIG. 6. The locking set screw 34 is used to set the handle 20 with the cutter blade 36 from left to right in the wide holes 18/18'. There is no such feature in your invention. A significant difference from your invention is that the blade is not rigidly held at any fixed depth below a bottom surface of a broad flat surface upon which the cutting tool rides. In addition, the provision of the extra leg 14' above which the carpet C is supported is an element which would interfere with the use of a tool designed in accordance with your invention. A basic difference is that the base does not rest upon the work, but the blade is slipped between the legs of the base in Sullivan et al.

4. U.S. Pat. No. 5,438,757 Weschenfelder "Multifunction Cutting Tool" shows a blade 40 which can be rotated, which is retrieved from storage slot 39 by loosening screws 16a and 16c. A screw driver is inserted into slot 43 in blade 40. Blade 40 is rotated around screw 16a to an extended position. See Col. 3, lines 1–7 and Col. 4, lines 4–18. There is also a fixed blade 80 and a foot 76 in blade holder 10.
5. U.S. Pat. No. 4,761,884 Nguyen et al. "Device for Trimming to a Net Shape the Edge of a Metal Skin" seems to teach a variation on a rotary saw with a rotary blade 28 seen in FIG. 3 turned by a saw (motor) 12. Nguyen et al. calls for a power driven rotary saw and a guide means for contacting the edge of a second skin.

U.S. Pat. No. 4,713,885 Kaliak et al "Safe Utility Knife" describes a conventional trapezoidal utility knife blade 19 with two top notches 20 fits into a slidable carrier 15 which includes an internal lug 16 which holds the blade in position between the shell halves 10 and 11 of the handle. The lever 23 is used to slide the blade in and out of the handle. It is shown in the blade retracted position in FIG. 2 and the blade extended position in FIG. 3.

U.S. Pat. No. 5,425,175 Rogers "Knife with Multiple Cutting Positions" shows how latching of a pivotable multiple position blade can be achieved. In FIGS. 1 to 4 of Rogers a biased engagement means 8 engages positioning means 6 and fixes blade 2 in each of two angular cutting positions (first cutting position 18 (FIG. 1) and a second cutting position 19 (FIG. 2)). The tail 12 of the blade 2 is locked in position by a locking member 15 which is biased by a coil spring 22 against the tail 12. The locking member 15 can be released from engagement with the tail 12 by an actuator 21 sliding through slot 34 seen in FIGS. 3 & 4. In the embodiment of FIGS. 5 and 6 blade 2 has three slots 40 (first cutting position 41), slot 42 (second cutting position 43) and 44 (folded or closed position 45) into which engagement tab 39 is urged by spring 11.

U.S. Pat. No. 4,868,985 Rehm "Utility Knife" describes a slide 12 located in a knife handle housing 10 with a pin 14 on which the blade 16 is placed for sliding in and out of the housing 10. The slide 12 is held in retracted position by a spring 18. A friction disk 22 which turns on axis 24 has a knurled lower surface which contacts the surface to be cut. As the knife moves in direction A, disk 22 turns in direction B pulling the slide 12 and blade 16 out to the position seen in FIG. 2 by winding pull wire 28 around cylindrical extension 38 on the side of disk 22 until the flat 26 on disk 22 is exposed to the surface of the work piece being cut. There is another embodiment in FIGS. 4–9 which use gear teeth in place of the pull wire 28.

U.S. Pat. No. 4,936,014 Shannan et al "Utility Knife" a blade B is carried in a carriage 64 as described at Col. 4, lines 15–Col. 5, line 22 which can be retracted and extended.

U.S. Pat. No. 5,490,331 Gold "Utility Knife for Cutting and Scraping" shows a double purpose push-pull knife with a double-edged blade 16. There is a pull-edge 32 for scoring a workpiece. The knife which has a finger contacting member 28 with a surface 30 against which a finger is pressed when the push-blade 26 is being used for scraping. While there is a push-pull feature for extending and retracting the blade in the housing there is no description of that feature.

U.S. Pat. No. 5,025,558 Gilbert "Utility Knives" describes retractable blade features and the housing for the blade.

U.S. Pat. No. 5,042,154 Gilbert "Utility Knives" is closely related to the Gilbert U.S. Pat. No. 5,025,558.

U.S. Pat. No. 5,144,749 Chen "Utility Knife" shows a retractable rotary blade which includes a blade shield. The blade can be pushed or pulled, like a pizza cutting blade.

U.S. Pat. No. 5,301,428 Wilcox "Utility Knife" describes a complicated mechanism which relates to retractability of a blade.

U.S. Pat. No. 5,511,261 Collins "Utility Tool" shows a set of tools which are retractable. Knife blade 54 can be held in a locked position by tightening a screw 28 by turning knob 30 (Col. 4, lines 13–37). There can be alternatives outlined at Col. 3, lines 56–65. The blade does extend down from flat face 39, but face 39 and the blade are not adapted for using the face 39 as a support resting on a workpiece when cutting that workpiece.

SUMMARY OF THE INVENTION

In accordance with this invention, a utility tool has a knife blade and a housing therefor. The housing means comprises a handle for supporting the knife blade adjustably rotatable to a plurality of fixed angular positions including means for locking the knife blade in the fixed angular positions. The housing including a flat base having an external surface adapted to be supported upon work to be cut by the knife blade; and the flat base of the housing including with a hole therethrough for the blade to extend into positions for cutting the work to be located below the base.

The housing means includes a shaft for supporting the blade, and preferably the shaft removably supports the blade; and the harness for supporting the blade prevents rotation of the blade during cutting.

Preferably, the housing means includes a shaft for supporting the blade, and means for locking the knife blade in the fixed angular positions includes locking means for holding the means for locking in a locked position.

Preferably, the housing means includes a shaft for supporting the blade; and the means for locking the knife blade in the fixed angular positions includes biasing means for holding the means for locking in a locked position. Preferably the biasing means comprises a biasing spring means for holding the means for locking the means for locking in a locked position.

Preferably, the housing means includes a shaft for supporting the blade, the means for locking the knife blade in the fixed angular positions includes biasing means for holding the means for locking in a locked position, and there is a harness for supporting the blade to prevent rotation of the blade during cutting.

Preferably, the housing means includes a shaft for supporting the blade, the means for locking the knife blade in the fixed angular positions includes biasing spring means for holding the means for locking in a locked position, and a harness for supporting the blade to prevent rotation of the blade during cutting.

In accordance with another aspect of this invention, a utility tool has a knife blade and a housing therefor. The housing comprises a handle for supporting the knife blade adjustably rotatable on a shaft for supporting the blade. The shaft is carried by a pair of bearings to a plurality of fixed angular positions and there are means for locking the knife blade in the fixed angular positions. The housing including a flat base having an external surface adapted to be supported upon work to be cut by the knife blade. The flat base of the housing includes a hole therethrough for the blade to extend into positions for cutting the work to be located below the base. The means for locking the knife blade in the fixed angular positions includes biasing means for holding the means for locking in a locked position. A harness for supporting the blade prevents rotation of the blade during cutting. Preferably, the means for locking the knife blade in the fixed angular positions includes biasing spring means for retaining the means for locking in a locked position.

In accordance with the method of this invention, a utility tool having a knife blade and a housing therefor is operated according to the following steps. Support the knife blade adjustably rotatable to a plurality of fixed angular positions including using means for locking the knife blade in the fixed angular positions. Providing a housing with a flat base having an external surface adapted to be supported upon work to be cut by the knife blade. Adjust the knife blade to extend through a hole in the flat base into positions for cutting the work to be located below the base cutting.

Preferably, provide housing means with a shaft for supporting the blade, preferably removably supporting the blade; and preferably providing a harness for supporting the blade to prevent rotation of the blade during cutting.

Preferably, provide means for locking the knife blade in the fixed angular positions including locking means for holding the means for locking in a locked position, preferably including biasing means for holding the means for locking in a locked position.

The housing means includes a shaft for supporting the blade. Provide the means for locking the knife blade in the fixed angular positions including biasing spring means for holding the means for locking in a locked position, wherein the housing means includes a shaft for supporting the blade.

Provide the means for locking the knife blade in the fixed angular positions including biasing means for holding the means for locking in a locked position; with a harness for supporting the blade to prevent rotation of the blade during cutting.

Preferably provide a housing means including a shaft for supporting the blade.

Provide the means for locking the knife blade in the fixed angular positions including biasing spring means for holding the means for locking in a locked position, and employing a harness for supporting the blade to prevent rotation of the blade during cutting.

Operate a utility tool having a knife blade and a housing therefor. Provide housing means comprising a handle for supporting the knife blade adjustably rotatable on a shaft for supporting the blade, the shaft being carried by a pair of bearings to a plurality of fixed angular positions including means for locking the knife blade in the fixed angular positions.

Provide a housing including a flat base having an external surface adapted to be supported upon work to be cut by the knife blade.

Provide the flat base of the housing including with a hole therethrough for the blade to extend into positions for cutting the work to be located below the base. Provide the means for locking the knife blade in the fixed angular positions including biasing means for holding the means for locking in a locked position. A harness for supporting the blade to prevents rotation of the blade during cutting.

Provide the means for locking the knife blade in the fixed angular positions including biasing spring means for retaining the means for locking in a locked position.

BRIEF DESCRIPTION OF THE DRAWINGS

The foregoing and other aspects and advantages of this invention are explained and described below with reference to the accompanying drawings, in which:

FIG. 4A shows a modified subassembly of a bullet blade and the shafts which support the bullet blade.

FIG. 4B shows a partially sectional view of a hollow shaft which has a hexagonal exterior surface, and a hexagonal cross section defining a hexagonal hollow interior space open at the right end to a receive actuator shaft with a shape conformal thereto.

FIG. 4C shows a hexagonal inner actuator shaft having a matching external hexagonal cross sectional surface which fits with the hexagonal cross section space within the mounting shaft with the hexagonal inner actuator shaft terminating in a cylindrical shaft end on the right.

FIG. 5A shows a slightly modified blade adapted to be used in the tool of FIG. 1 and the subassembly of FIG. 4A in a perspective view with a cutting edge at the bottom and a head at the top and a hexagonal mounting hole in the middle.

FIG. 5B shows the a mounting harness in a fragmentary perspective view with a hexagonal mounting hole in the middle.

FIG. 6 shows a side view of the threaded actuator screw in the locking plate.

FIG. 7A shows a hexagonal outer and inner surface mounting shaft with a hollow space therein for hexagonal inner actuator shaft with the cylindrical shaft end on the right extending from shaft.

FIG. 7B shows a sectional view taken along line 7B-7B' of the shaft showing how the two hexagonally shaped members fit together so that shaft can reciprocated longitudinally within the mounting shaft.

DESCRIPTION OF THE PREFERRED EMBODIMENT

Figure 1:
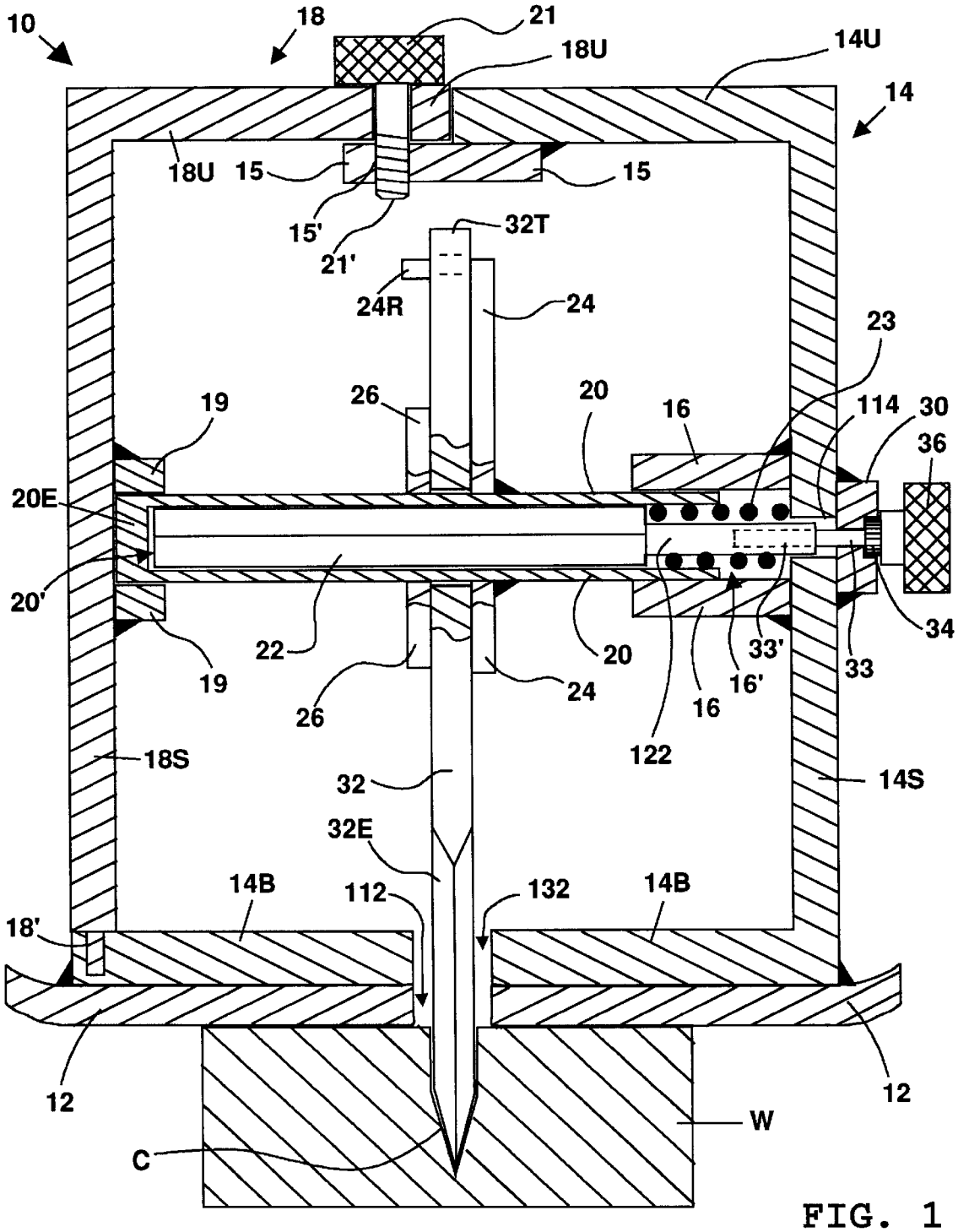
FIG. 1 shows a front sectional elevation of a cutting tool in accordance with this invention.

FIG. 1 shows a front sectional elevation of a cutting tool 10 in accordance with this invention. Tool 10 is adapted for use as a utility knife 10 which includes an adjustable angle bullet blade 32 (shown in a perspective view in FIG. 5A) with a cutting edge of blade end 32E useful for cutting work materials W such as sheet rock, etc. leaving a cut C. The blade 32 is mounted on a shaft 20 manually adjustable by rotation to a number of fixed angular positions. The tool 10 provides the adjustment of fixed angular positions by means for locking the bullet blade 32 in position. A housing for the blade 32 is formed by two shells 14 and 18. Means in accordance with this invention are provided for manually adjusting the angle of bullet blade 32 relative to the work W to number of fixed angular positions within the housing provided by shells 14 and 18, as will be explained in detail below.

Figure 2:
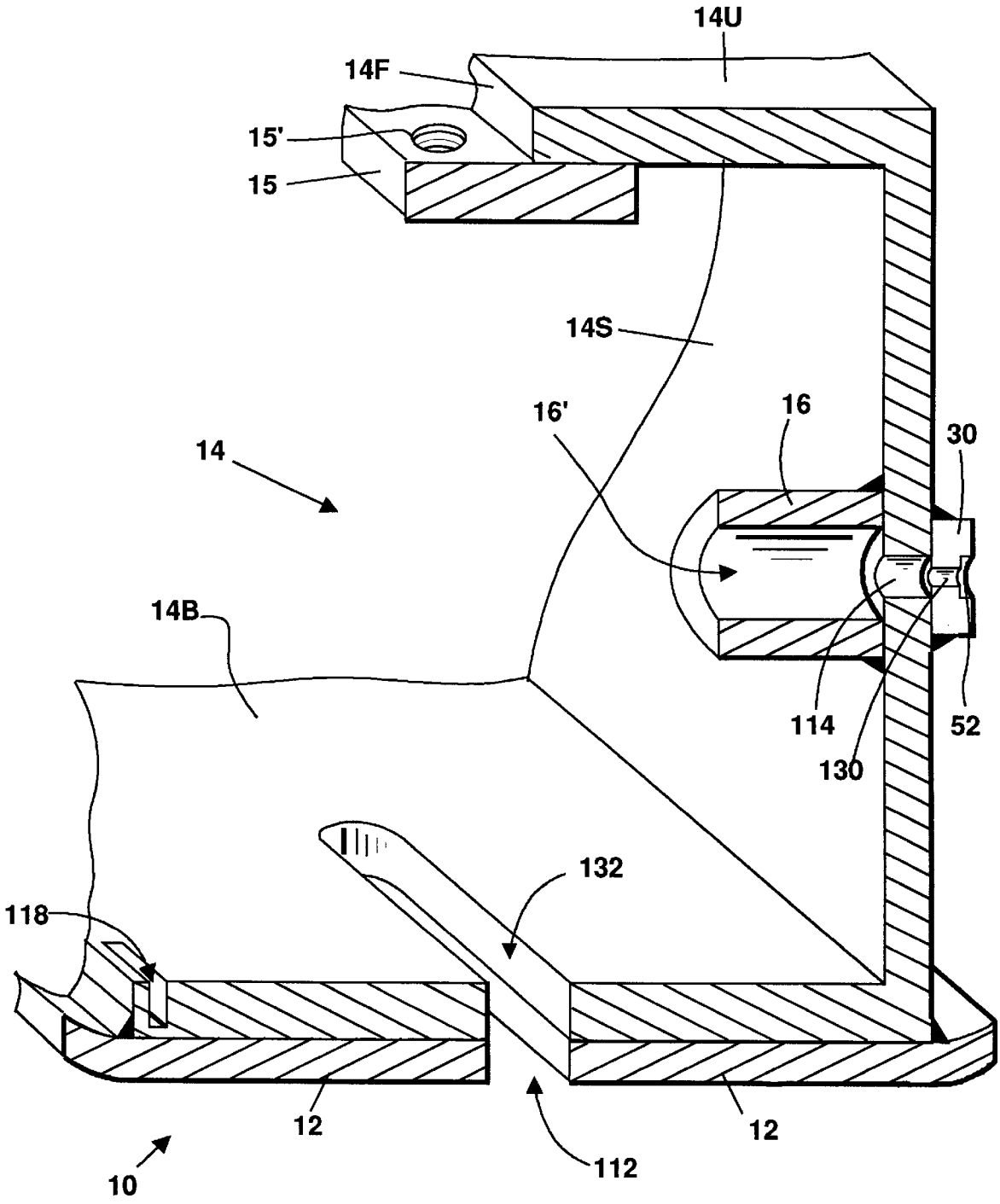
FIG. 2 shows a fragmentary perspective view of the main shell of the tool which is secured to a flat base

FIGS. 1 and 2 show the main shell 14 secured to a flat base 12 which rides upon the work W.

FIG. 2 shows a fragmentary perspective view of the main shell 14 which is secured to a flat base 12 which serves as a slide plate which slides across the work W when the tool is driven across the work by forces exerted manually by the operator to pull the cutting edge 32E of the bullet blade 32 across the work W to create a cut C. Main shell 14 is formed with an upper horizontal plate 14U, a side plate 14S and a bottom plate 14B which may be welded together or which may be unitary as shown in FIG. 2.

The upper plate 14U is narrower than the bottom plate 14B since main shell 14 is complementary to the cover shell 18 above the bottom plate 14B which means that space must be allowed for the projection of plate 18U of the cover shell 18.

The upper plate 14U carries on its lower surface a tab 15 comprising a smaller metal plate welded to main shell 14 beneath its upper plate 14U. Tab 15 includes a threaded hole 15' for receiving a screw 21 seen in FIG. 1 for fastening the cover shell 18 to the main shell 14.

A hollow, circular cross section cylindrical bearing 16 is joined by bonding to the interior of side plate 14S of main shell 14, as can be seen in FIG. 2. There is a cylindrical opening 16' in bearing 16 which is provided to support the shaft 20 which carries the blade 32. There is a cylindrical, unthreaded opening 114 coaxial with the bearing 16 for extension therethrough of cylindrical shaft end 122 when the blade angle is being adjusted by pulling on knob 36 to disengage the antirotation lock before turning knob 36 to rotate blade 32 to a new angle.

On the opposite (exterior) side of side plate 14 from bearing 16, there is locking plate 30 seen in FIGS. 1, 2, 6 and 9 which is affixed by a bonded joint to the main shell 14. Locking star plate 30 includes an unthreaded cylindrical throughhole opening 130 through locking star plate 30 coaxially aligned with the opening 114 in the bearing 16. Opening 130 is provided for blade angle adjustment actuator screw 33 to have free extension and reciprocation therethrough as well as rotation of actuator screw 33 therein to actuate adjustment of angular position of the bullet blade 32.

There is a stationary star-shaped hole 52 in locking star plate 30 aligned with the bearings 16 and 19. As seen in FIG. 1 the actuator screw 33 fits through the opening 16' in bearing 16 and opening 114 in main shell 14 as well as opening 130 in locking star plate 30.

There is blade slot 132 through in the bottom 14B of main shell 14 and a matching, aligned slot hole 112 in the base 12. The slot holes 132 and 112 permit the bullet blade 32 to reach through bottom slide plate so the cutting edge 32E is exposed to cut the work W which is located below the base 12 as is seen in FIG. 1.

There can be three slots 118 in main shell 14 on the left edge of bottom plate 14B for receiving matching tabs 18' of the cover shell 18. FIG. 2 shows only one slot 118 for convenience of illustration.

Figure 3:
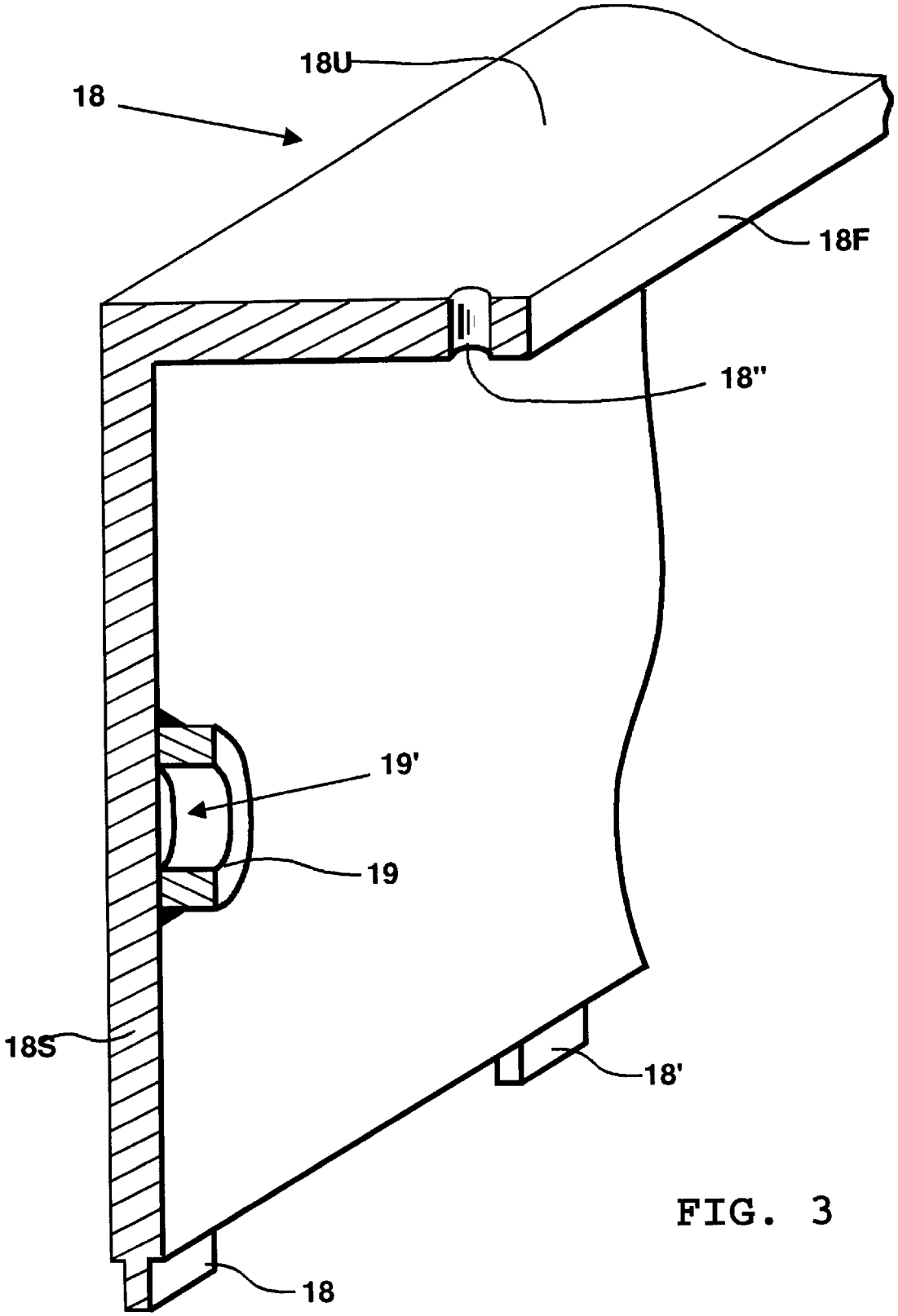
FIG. 3 shows a fragmentary perspective view of the cover shell formed of a side plate on the left and a top plate above the side plate.

FIGS. 1 and 3 show the cover shell 18. FIG. 3 shows a fragmentary perspective view of cover shell 18 formed of a side plate 18S on the left and top plate 18U above the side plate 18S.

Bearing 19 is formed on the interior of side plate 18S of cover shell 18. Circular cross section bearing 19 includes a cylindrical hollow space 19' for receiving the left end of shaft 20.

Top plate 18U includes a cylindrical screw hole 18" which permits free extension therethrough of screw 21 which includes threaded end 21' which is to fit into hole 15' in tab 15 to lock the two shells 14 and 18 together.

FIG. 4A shows a modified subassembly of a modified blade 32' and the shaft 20, etc., which is discussed in greater detail below.

FIG. 4B shows a partially sectional view of hollow shaft 20 which has a hexagonal exterior surface 20, and a hexagonal cross section defining hexagonal a hollow interior space 20' open at the right end to receive actuator shaft 22 with a shape conformal thereto. The hexagonal mounting shaft 20 is supported for rotation about its longitudinal axis by extension into cylindrical spaces 16' and 19' in bearings 16 and 19. The left end 20E of hexagonal mounting shaft 20 can be enclosed or, alternatively, it can be open throughout the length thereof. It should be noted that the hexagonal shaft 20 can be supported for limited rotation within the cylindrical bearings 16 and 19 since little loading occurs during adjustment and little wear will occur since the adjustment is not continuous.

FIG. 4C shows hexagonal inner actuator shaft 22 having a matching external hexagonal external cross sectional surface 22H which fits with the hexagonal cross section internal space 20' within the mounting shaft mounting shaft 20.

Hexagonal inner actuator shaft 22 terminates in a cylindrical shaft end 122 on the right with a coaxial threaded screw hole 133 into which actuator screw 33 is secured coaxially by the threaded screw end 33' of actuator screw 33.

Shaft 22 must be reduced to the diameter of cylindrical shaft end 122 to accommodate the compression spring 23. Threaded end 33' of actuator screw 33 has a thread which tightens as pressure is exerted on blade end 32E by the work W.

Shaft 22 and cylindrical shaft end 122 are locked in position by the actuator screw 33 which has a head 36 with a star toothed locking wheel 34 formed on the base thereof which locks actuator screw 33 in a stationary star-shaped hole 52 in locking star plate 30 affixed by a bonded joint to the exterior of main shell 14, aligned with the bearings 16 and 19.

In FIG. 1, a blade harness 24 (mounting bracket seen in perspective in FIG. 5B) is joined by bonding to the exterior of the mounting shaft 20 adjacent to the position in which blade 20 is to be mounted. Rear arm 24R of harness 24 lies behind the blade 32. Rear arm 24R pushes against the back of the top end 32T of blade 32 to turn and support the blade 32 in a fixed position within the tool shells 14 and 18, when bullet blade 32 is cutting work W. In FIG. 1, on the left of blade 32, a spring locking friction grip washer 26 secures blade 32 to the exterior of the mounting shaft 20. In the case of the modified embodiment of FIG. 4A instead of the hexagonal opening 232 in blade 32' as seen in FIG. 5A which slips over the shaft 20 the opening is enlarged as will be well understood by those skilled in the art to slip blade 32 onto screw 25 for mounting of blade 32 in a stable position on the shaft 20.

In FIG. 4A, a hollow externally threaded screw element 25 has been slipped onto the shaft 20 and joined by bonding (brazing or welding) thereto to the left of harness 24. A threaded fastener composed of screw 25 and nut 27 which tightens against washer 26' to lock blade 32' to the shaft 22.

FIG. 5A shows a slightly modified blade 32 adapted to be used in the tool of FIG. 1 or the subassembly of FIG. 4A in a perspective view with cutting edge 32E at the bottom and head 32H at the top and a hexagonal mounting hole 232 in the middle. The hole 232 in blade 32 permits blade 32 to slip over the left end of shaft 20 seen in FIGS. 4B and 7A until it reaches the mounting harness 24 seen in perspective in FIG. 5B which is bonded to the exterior of shaft 20 as described above.

FIG. 5B shows the mounting harness 24 in a fragmentary perspective view with a hexagonal mounting hole 224 in the middle. The hole 232 through harness 24 permits harness 24 to slip over the left end of shaft 20 seen in FIGS. 4B and 7A until it reaches the position where it is bonded to the shaft 20 for supporting the blade 32.

FIG. 6 shows a side view of the threaded actuator screw 33 in the locking star plate 30. Screw 33 has a head including a knob 36 with a star toothed locking wheel 34 formed on the base thereof which locks actuator screw 33 in place in locking star plate 30. Between the knob 36 and the star tooth locking wheel 34 is located a shoulder 35. The left end 33' of the actuator screw 33 is threaded for joining the actuator screw 33 to the inner actuator shaft 22 to actuate the mounting shaft 20.

FIG. 7A shows a hexagonal outer and inner surface mounting shaft 20 with through opening 123 into the hollow space 20' not shown in FIG. 7A, but shown in FIG. 4B therein for hexagonal inner actuator shaft 22 with the cylindrical shaft end 122 on the right extending from shaft 20. A coaxial threaded screw hole 133 is provided into which actuator screw 33 is secured coaxially by the threaded screw end 33' of actuator screw 33.

Shaft end 122 is cylindrical and of reduced diameter below that of the hexagonal left end of shaft 22 seen in FIGS. 1 and 4C to accommodate the compression spring 23.

FIG. 7B shows a sectional view taken along line 7B–7B' of the shafts 20 and 22 showing how the two hexagonally shaped members fit together so that actuator shaft 22 can reciprocated longitudinally within the mounting shaft 20.

Figure 8A:
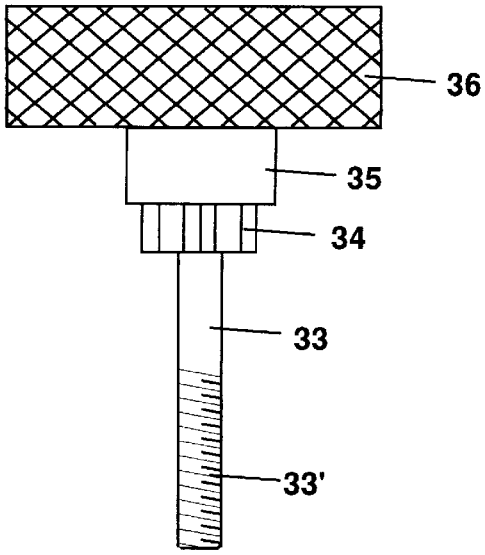
FIG. 8A shows a side view of an actuator screw with a head with a shoulder between the head and an actuator wheel thereon.

FIG. 8A shows a side view of the actuator screw 33 with a knob 36 with a shoulder 35 between the knob 36 and the star tooth locking wheel 34. The star toothed locking wheel 34 formed on the base of shoulder 35 locks actuator screw 33 in place in locking star plate 30, shown in FIGS. 1 and 9. The lower end 33' of the actuator screw 33 is threaded for joining the actuator screw 33 to the shaft 22 to actuate the shaft 20.

Figure 8B:
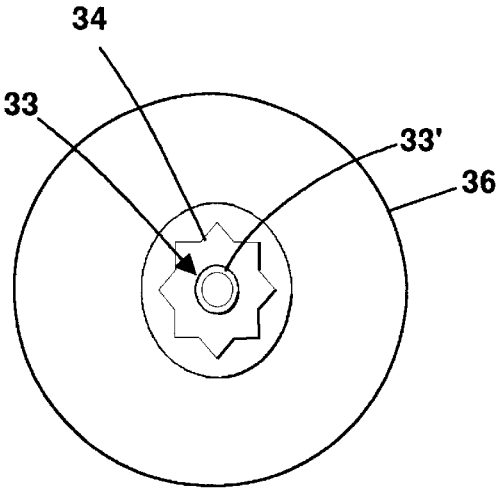
FIG. 8B shows and end view of actuator screw showing the sharp teeth of star toothed locking wheel.

FIG. 8B shows and end view of actuator screw 33 showing the sharp teeth of star toothed locking wheel 34.

Figure 9:
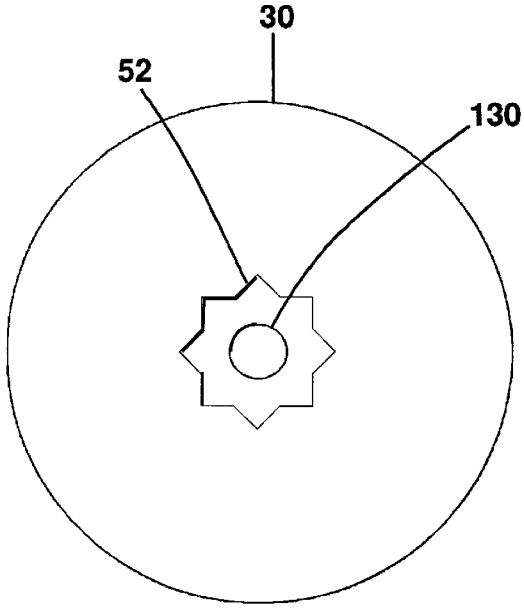
FIG. 9 shows an end view of the star plate through which is formed a cylindrical hole aligned coaxially with the actuator screw, the main shaft bearings and a star-shaped hole formed in star plate.

FIG. 9 shows an end view of locking star plate 30 with a cylindrical through hole 130 aligned coaxially with actuator screw hole 133, the hollow cylindrical bearings 16 and 19 stationary and the star-shaped hole 52 formed in locking star plate 30. As seen in FIG. 1 the actuator screw 33 has star toothed locking wheel 34 (FIGS. 8A and 8B) which fits through the opening 16' in bearing 16 and opening 114 in main shell 14 plus opening 130 in locking star plate 30.

Figure 10:
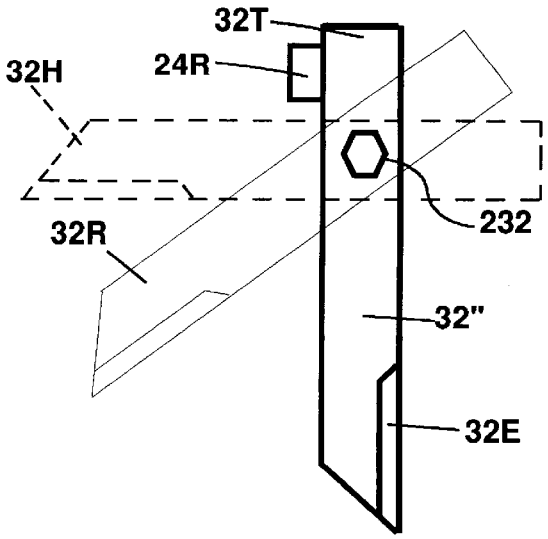
Referring to FIG. 10 several exemplary positions of a slightly modified bullet blade adapted to be used in the tool of FIG. 1 and the subassembly of FIG. 4A.

Referring to FIG. 10 several exemplary positions of a blade 32" are illustrated which include, as follows:

1) the extended position seen in FIG. 10 in bold lines, 2) the angular position 32R seen in light lines, and 3) the horizontal position 32H seen is dotted lines.

Note that FIG. 10 shows the rear arm 24R of harness 24 behind the blade 32" which pushes against the back of the top end 32T of blade 32" to turn and hold the blade in position when it is cutting a work piece.

In summary, when assembling the shells 18 and 14 together, side plate 18S of cover shell 18 fits upon the left edge of bottom plate 14B. Cover shell 18 is removably fastened to main shell 14 by means of three tabs 18' which fit into a slots 118 in bottom plate 14B of main shell 14 in FIG. 2 and by means of main shell mounting tab 15 (welded to main shell 14 beneath its upper plate 14U) and threaded screw 21 which includes threaded end 21' which threads through matching threaded opening 15' in tab 15.

The tool 10 is adapted to be supported upon work W to be cut by the cutting edge 32E of bullet blade 32. The cutting edge 32E extends down through blade slot 132 in the bottom of main shell 14 and a matching, aligned slot hole 112 in the base 12. The slot holes 132 and 112 permit the bullet blade 32 to reach through bottom slide plate so the cutting edge 32E is exposed for cutting the work W located below the base 12.

The user of the tool 10 can pull the tool 10 along the surface of the work W with the assurance that the utility knife blade edge 32E will cut to a preset depth unlike the commercially available utility knives which will cut to various depths depending upon the force applied to the blade handle by the user. The preset depth of cut is adjusted by the user simply by releasing the quick release position star tooth locking wheel 34 of the bullet blade and rotating the bullet blade 32 to one of a number of preset positions.

While the bullet blade 32 is quickly adjustable to a number of preset angular positions which change the depth of the cut, the bullet blade 32 is held in a fixed position at any given time by star toothed locking wheel 34 which is spring biased into a locking position inserted into stationary star shaped slotted locking star plate 30. Although an analogy which can be drawn to a rotary saw with a wide, flat base with an opening through which a blade extends to provide stability of the lateral angular position of the blade relative to the work being cut, the invention relates to a bullet blade 32 with a cutting edge 32E held during cutting in a fixed position. Unlike a rotary saw, the blade 32 does not rotate when cutting and is operated manually by an operator pushing the device 10 including shells 14/18 across a work piece to cut the surface thereof. Blade 32 is not motor driven.

In FIG. 1, the blade 32 (shown in perspective in FIG. 5B) includes a hexagonal mounting hole 232 through the thickness thereof for mounting of blade 32 on a rotatably supported hexagonal cross section mounting shaft 20 (shown in perspective in FIG. 5D and in cross section in FIG. 7B). Shaft 20 has a hexagonal exterior cross section as well as a hexagonal cross section hollow interior space 20'. The mounting shaft 20 is supported for rotation about its longitudinal axis by bearings 16 and 19. Bearing 16 is on the interior of main shell 14, as can be seen in FIG. 3. Bearing 19 on the interior of side plate 18S of cover shell 18 can also be seen in FIG. 2. As shown the left end 20E of hexagonal mounting shaft 20 can be enclosed or, alternatively, it can be open throughout the length thereof.

The blade 32 is held on mounting shaft 20 on the right by the harness 24 (mounting bracket seen in perspective in FIG. 5B) which is joined by bonding to the exterior of the mounting shaft 20. In FIGS. 1 and 5B, harness 24 includes a hexagonal mounting hole 224 through the thickness thereof is slidably mounted on a rotatably supported hexagonal mounting shaft 20 before brazing the harness 24 to the mounting shaft 20. On the left of blade 32, a spring locking friction grip washer 26 securing blade 32 to the exterior of the mounting shaft 20. FIG. 4A shows providing a threaded fastener composed of screw 25 and nut 27 which tightens against washer 26' to lock blade 32' to the actuator shaft 22.

The mounting shaft 20 is locked in position by the inner shaft 22 which is secured to the star tooth locking wheel 34. Shaft 22 has a matching external hexagonal cross section surface which fits with the hexagonal cross section space 20 within the mounting shaft mounting shaft 20 on the left and a cylindrical shaft end 122 on the right with a coaxial threaded screw hole 133 into which actuator screw 33 is secured coaxially by the threaded screw end 33' of actuator screw 33. Threaded end 33' of actuator screw 33 has a thread which tightens as pressure is exerted on blade end 32E by the work W. Shaft 22 and cylindrical shaft end 122 are locked in position by the actuator screw 33 which has a head 36 with a star toothed locking wheel 34 formed on the base thereof which locks actuator screw 33 in a stationary star-shaped hole 52 in locking star plate 30 affixed by a bonded joint to the exterior of main shell 14, aligned with the bearings 16 and 19. The screw fits through the opening 16' in bearing 16 and opening 114 in main shell 14 as well as opening 130 in locking star plate 30 (as shown in FIG. 2.) The star star toothed locking wheel 34 on the screw head 36 is retained engaged with wheel locked into hole 52 in the star plate 30 by the biasing force of coil spring 23 which is coaxial with cylindrical shaft end 122 and which pushes on the end of hexagonal inner actuator shaft 22 at the shoulder where it is joined cylindrical shaft end 122. The coil spring 23, which is compressed between the inner actuator shaft 22 and the inner wall of main shell 14, therefore exerts a strong force on star lock wheel 34 to hold it in the toothed stationary star-shaped hole 52.

The double action knob 36 is adapted for pulling the star lock wheel 34 from the hole 52 to release the lock to permit turning of the actuator screw which turns the cylindrical shaft end 122, and the hexagonal inner actuator shaft 22 to turn the blade 32 between the extended position seen in FIG. 10 in bold lines to other angular positions.

While this invention has been described in terms of the above specific embodiment(s), those skilled in the art will recognize that the invention can be practiced with modifications within the spirit and scope of the appended claims, i.e. that changes can be made in form and detail, without departing from the spirit and scope of the invention. Accordingly all such changes come within the purview of the present invention and the invention encompasses the subject matter of the claims which follow.

Having thus described the invention, what is claimed as new and desirable to be secured by Letters Patent is as follows:

1. A utility tool having a knife blade and a housing therefor, housing means comprising a handle for supporting said knife blade adjustably rotatable to a plurality of fixed angular positions including means for rotating a cutting edge of said knife blade and position locking means for locking said knife blade in said plurality of fixed angular positions for depth of cut adjustment to a depth of cut of said cutting edge which corresponds to a said fixed angular position said knife blade, said position locking means including a lock including a movable lock member and a stationary lock member, said movable lock member being normally in a locked position in engagement with said stationary lock member, said movable lock member being adapted for being quickly removed from said locked position to permit free rotation of said knife blade to another one of said fixed angular positions whereby said movable position lock member can be quickly engaged with said stationary lock member in another of said fixed positions, a knob for manually applying force to disengage said movable lock member from said locked position to permit manual rotation of said knife to any of said fixed angular positions by turning said knob, and said housing including a flat base having an external surface adapted to be supported upon work to be cut by said knife blade, and said flat base of said housing including with a hole therethrough for said blade to extend into positions for cutting the work to be located below said base.

2. A utility tool in accordance with claim 1 wherein:

said housing means includes an outer hollow shaft for supporting said knife blade, and an inner shaft fitting within said outer shaft, and said inner shaft being connected to said knob and said movable position lock member.

3. A utility tool in accordance with claim 1 wherein:

said housing means includes an outer hollow shaft for removably supporting said knife blade, an inner shaft fitting within said outer shaft, and said inner shaft being connected to said knob and said movable position lock member, and a harness for supporting said blade to prevent rotation of said blade during cutting.

4. A utility tool in accordance with claim 1 wherein:

said housing means includes an outer hollow shaft for supporting said knife blade, an inner shaft fitting within said outer shaft, and said inner shaft being connected to said knob and said movable position lock member, and said position locking means for locking said knife blade in said fixed angular positions includes biasing means for holding said position locking means for locking in a locked position.

5. A utility tool in accordance with claim 1 wherein:

said housing means includes a shaft for supporting said knife blade, said position locking means for locking said knife blade in said fixed angular positions includes biasing spring means for holding said position locking means for locking in a locked position.

6. A utility tool in accordance with claim 1 wherein:

said housing means includes a shaft for supporting said knife blade, said position locking means for locking said knife blade in said fixed angular positions includes biasing means for holding said position locking means for locking in a locked position, with said depth of cut being a function of said plurality of fixed angular positions of said knife blade, and a harness for supporting said knife blade to prevent rotation of said knife blade during cutting.

7. A utility tool in accordance with claim 1 wherein:

said housing means includes a shaft for supporting said knife blade, said locking means includes spring biasing means which comprises spring means for holding said position locking means for locking said knife blade in a locked position, and a harness for supporting said knife blade to prevent rotation of said knife blade during cutting.

8. A utility tool having a knife blade and a housing therefor, housing means comprising a handle for supporting said knife blade adjustably rotatable on a blade shaft for supporting said knife blade, said blade shaft being carried by a pair of bearings to a plurality of fixed angular positions for adjustment of the depth of cut of a cutting edge of said knife blade as a function of adjustment of fixed angular positions of said cutting edge of said knife blade, with said depth of cut being a function of said plurality of fixed angular positions of said knife blade, said tool including position locking means for locking said knife blade and said blade shaft in said fixed angular positions, an actuator shaft connected to said blade shaft for longitudinal reciprocation of said actuator shaft relative to said blade shaft, and said actuator shaft and said blade shaft fitting together, a knob being connected to said actuator shaft for turning said actuator shaft, said blade shaft, and said knife to angular positions to vary said depth of cut of said knife, said position locking means including a lock including a movable lock member and a stationary lock member integral with said housing means, said knob, said movable lock member and said actuator shaft being biased to a locking position, and said movable lock member being adapted for quick withdrawal from said locking position in response to a manual pull on said knob whereby said movable lock member is in a disengaged, unlocked position which permits free rotation of said shafts and said knife blade to another angular position, at which, by releasing said pull on said knob said movable lock member quickly reengages in another engaged locking position with said stationary lock member and said knife is retained in another one of said plurality of fixed angular positions, said housing including a flat base having an external surface adapted to be supported upon work to be cut by said knife blade, said flat base of said housing including with a hole therethrough for said knife blade to extend into positions for cutting the work to be located below said base, said position locking means for locking said knife blade in said fixed angular positions includes biasing means for holding said position locking means for locking in a locked position, and a harness for supporting said knife blade to prevent rotation of said knife blade during cutting.

9. A utility tool in accordance with claim 8 wherein:

said knob has a base, said position locking means for locking said knife blade in said fixed angular positions includes biasing spring means for retaining said position locking means for locking in a locked position and said movable lock member is formed on said base of said knob, and said housing means includes said stationary lock member having an opening conformal with said movable lock member.

10. A method for operating a utility tool having a knife blade and a housing therefor comprising:

supporting said knife blade adjustably rotatable to a plurality of fixed angular positions including rotating said knife blade and using position locking means for locking said knife blade in a plurality of said fixed angular positions for depth of cut adjustment of a cutting edge of said knife blade to a depth of cut which corresponds to a said fixed angular position of said knife blade, with said depth of cut being a function of said plurality of fixed angular positions of said knife blade, providing a housing with a flat base having an external surface adapted to be supported upon work to be cut by said knife blade, providing said position locking means which includes a lock including a knob connected to a movable lock member which is biased to a locking position and said movable lock member being adapted for quick withdrawal from a fixed position lock member in response to a manual pull on said knob to remove said movable lock member from said locking position into a disengaged, unlocked position which permits free rotation of said knife blade to another angular position, at which, by releasing said pull on said knob said movable position lock member quickly reengages in another engaged locking position with said fixed position lock member and said knife is retained in another one of said plurality of fixed angular positions, and turning said knob for adjusting said knife blade to extend through a hole in said flat base into positions for cutting the work to be located below said base cutting.

11. A method of operating a utility tool in accordance with claim 10 wherein:

providing housing means including a shaft for supporting said knife blade.

12. A method of operating a utility tool in accordance with claim 10 wherein:

providing said housing means including a shaft for removably supporting said knife blade, and providing a harness for supporting said knife blade to prevent rotation of said knife blade during cutting.

13. A method of operating a utility tool in accordance with claim 10 wherein:

providing said housing means including a shaft for supporting said knife blade, providing said position locking means for locking said knife blade in said fixed angular positions including locking means for holding said position locking means for locking in a locked position.

14. A method of operating a utility tool in accordance with claim 10 wherein:

providing said housing means including a shaft for supporting said knife blade, providing said position locking means for locking said knife blade in said fixed angular positions including biasing means for holding said position locking means for locking in a locked position.

15. A method of operating a utility tool in accordance with claim 10 wherein:

said housing means including a shaft for supporting said knife blade, providing said position locking means for locking said knife blade in said fixed angular positions including biasing spring means for holding said position locking means for locking in a locked position.

16. A method of operating a utility tool in accordance with claim 10 wherein:

said housing means including a shaft for supporting said knife blade, providing said position locking means for locking said knife blade in said fixed angular positions including biasing means for holding said position locking means for locking in a locked position, and a harness for supporting said knife blade to prevent rotation of said knife blade during cutting.

17. A method of operating a utility tool in accordance with claim 10 wherein:

providing said housing means including a shaft for supporting said knife blade, providing said position locking means for locking said knife blade in said fixed angular positions including biasing spring means for holding said position locking means for locking in a locked position, and a harness for supporting said knife blade to prevent rotation of said knife blade during cutting.

18. A method in accordance with claim 10 for operating a tool having a knife blade and a housing therefor, housing means comprising a handle for supporting said knife blade adjustably rotatable on a shaft for supporting said knife blade, said shaft being carried by a pair of bearings to a plurality of fixed angular positions including position locking means for locking said knife blade in said fixed angular positions, providing said housing including a flat base having an external surface adapted to be supported upon work to be cut by said knife blade, providing said flat base of said housing including a hole therethrough for said knife blade to extend into positions for cutting the work to be located below said base, providing said position locking means for locking said knife blade in said fixed angular positions including biasing means for holding said position locking means for locking in a locked position, providing said position locking means including a lock including a knob connected to a movable position lock member which is biased to a locking position and said lock member being adapted for quick withdrawal from a fixed position lock member in response to a manual pull on said knob to remove said movable position lock member from said locking position into a disengaged, unlocked position which permits free rotation of said knife blade to another angular position, at which, by releasing said pull on said knob said movable position lock member quickly reengages in another engaged locking position with said fixed position lock member and said knife is retained in another one of said plurality of fixed angular positions, and providing a harness for supporting said knife blade to prevent rotation of said knife blade during cutting.

19. A method of operating a utility tool in accordance with claim 18 wherein:

providing said position locking means for locking said knife blade in said fixed angular positions including biasing spring means for retaining said position locking means for locking in a locked position in each of said fixed angular positions of said knife blade, and providing a knob connected to said blade and said locking means for pulling said knob axially and rotating said blade to a new position and releasing said knob in said locked position.

20. A method of operating a utility tool in accordance with claim 18 wherein:

providing said position locking means for locking said knife blade in said fixed angular positions including biasing spring means for retaining said position locking means for locking in a locked position in each of said fixed angular positions of said knife blade, and providing a knob connected to said blade and said locking means for pulling said knob axially and rotating said blade to a new position and releasing said knob in said locked position, providing an actuator shaft connected to said blade shaft for longitudinal reciprocation of said actuator shaft relative to said blade shaft, and said actuator shaft and said blade shaft fitting together, connecting said knob to said actuator shaft for turning said actuator shaft, said blade shaft, and said knife to angular positions to vary said depth of cut of said knife, said position locking means including a lock including a movable lock member and a stationary lock member integral with said housing means, biasing said knob, said movable lock member and said actuator shaft to a locking position, and said movable lock member being adapted for quick withdrawal from said locking position in response to a manual pull on said knob whereby said movable lock member is in a disengaged, unlocked position which permits free rotation of said shafts and said knife blade to another angular position, at which, by releasing said pull on said knob said movable lock member quickly reengages in another engaged locking position with said stationary lock member and said knife is retained in another one of said plurality of fixed angular positions.

* * * * *